United States Patent [19]

Pollock, Jr.

[11] Patent Number: 4,783,925

[45] Date of Patent: Nov. 15, 1988

[54] PNEUMATIC PROJECTILE DISCHARGER FOR MUZZLELOADING FIREARMS

[76] Inventor: Harold R. Pollock, Jr., 17 Circle Dr., Stonington, Conn. 06378

[21] Appl. No.: 127,915

[22] Filed: Dec. 2, 1987

[51] Int. Cl.[4] ..... F41C 27/00

[52] U.S. Cl. ..... 42/90; 42/95

[58] Field of Search ..... 42/90, 51, 95, 106

[56] References Cited

U.S. PATENT DOCUMENTS 4,328,632 5/1982 Beers ..... 42/95

FOREIGN PATENT DOCUMENTS 3207783 9/1983 Fed. Rep. of Germany ..... 42/90

*Primary Examiner*—Charles T. Jordan

*Attorney, Agent, or Firm*—K. Bradford Adolphson

[57] ABSTRACT

A pneumatic projectile discharging device uses cylinders of compressed gas for unloading or removing obstructions from the barrel of muzzle-loading guns. The device includes a valve body, a hollow handle piece, an adapter and a plurality of actuators which allow the device to be used on various types of guns. One end of the valve body is equipped with means for providing an airtight seal with the cylinder and means for piercing the end of the cylinder to release the gas. The cylinder of compressed gas is enclosed by the hollow handle piece which is detachably connected to the valve body and is provided with means for advancing the cylinder causing the end thereof to be pierced by the piercing means. The valve body houses a valve to selectively release the gas from the cylinder through a connecting passage. The upper portion of the valve body is provided with the adapter for sealing to the nipple or vent in the breech of a muzzle-loading gun. When a cylinder has been inserted and pierced and the proper actuator has been connected, the device can be fitted to the nipple or vent in the breech of the gun and pressed forward to open the valve and release the pressurized gas. The pressurized gas is released into the gun behind the charge or obstruction pushing it through the barrel and out of the gun. Various ways for introducing the pressurized gas into the barrel are disclosed.

25 Claims, 4 Drawing Sheets

PNEUMATIC PROJECTILE DISCHARGER FOR MUZZLELOADING FIREARMS

BACKGROUND OF THE INVENTION

The present invention relates generally to firearms and more particularly to the removal of projectiles and obstructions from muzzle-loading guns without firing the same.

Interest in collecting and shooting muzzle-loading guns has been increasing for many years. Muzzle-loading guns fall generally into two well known categories: flintlock and percussion. Because of the increasing value and scarcity of originals, manufacturers of firearms have begun making reproductions for shooters to use. An entire industry has grown up around this sport. There are now manufacturers in this and other countries making copies of antiques as well as new designs for hunting and target use. There are even target shooting competitions on the international level, and many states have set up special seasons for hunters using muzzle-loading guns.

Modern firearms use ammunition that is pre-assembled into a cartridge or shotshell containing the powder charge, projectile(s) and priming, all in a convenient casing usually made of metal and/or plastic. On the other hand, muzzle-loading guns use "unfixed" or "loose" ammunition For each shot, a measured amount of black powder must be poured down the barrel into the breech of the muzzle-loading gun. The projectile, usually a round ball wrapped in a greased patch or a conical "minnie balls", is pushed into the barrel and rammed down tightly against the powder charge with the ramrod. The gun is then ready to be primed and discharged.

On occasion, it is necessary to remove the projectile from the muzzle-loading gun by means other than firing it out. This can happen when (1) the shooter simply decides not to shoot, (2) the powder becomes spoiled by exposure to moisture or an over oiled barrel, or (3), as sometimes happens, the shooter forgets to load the powder first.

If no powder is in the gun, it is sometimes possible to get enough powder into the breech behind the projectile to permit it to be shot out. For example, by removing the nipple of a percussion gun, working some powder into the area ahead of the nipple, replacing the nipple, and repriming, the barrel can sometimes be shot clear. Some flintlocks have removable vent liners and a similar procedure can be followed.

To remove a projectile, the prior art also teaches use of a ball screw, closely resembling a wood screw, usually mounted on the end of a ramrod. The ball screw is pushed down the barrel and screwed into the lead projectile which can then be pulled out of the gun. If the projectile is not held firmly in the breech of the gun due to an undersized projectile or because of corrosion enlarging the breech area, it will be difficult or impossible to work the ball screw into it. Conversely, if the projectile is lodged too tightly in the breech, the ball screw will pull out and leave the projectile in the gun.

In the case of the ball screw, it is hazardous to be working over the muzzle of the gun if the gun is loaded as the position normally assumed by the shooter while using a ball screw almost assures personal injury in the event of an accidental discharge. Some experts recommend that water be poured into the barrel to wet the powder and render the gun harmless before using a ball screw to unload it.

If the above methods are not successful, it is usually necessary to take the gun to a gunsmith to have the barrel cleared.

SUMMARY OF THE INVENTION

The present invention is designed to overcome the abovenoted limitations, and toward this end, it contemplates the provision of novel projectile discharger which eliminates the need to work over the muzzle of the loaded gun to remove a projectile therefrom.

It is an object of the present invention to provide such a projectile discharger which eliminates the need to ruin the powder by wetting or ruin the projectile with the ball screw thereby saving these components for reuse Still another object is to provide such a projectile discharger in which pressurized gas is used to unload or remove obstructions from a muzzle-loading gun.

A further object is to provide such a projectile discharger which may be readily fabricated and will enjoy a long life in operation.

It has now been found that the foregoing and related objects can be readily attained in a projectile discharger comprising a pneumatic discharging device for unloading or removing obstructions from a percussion muzzle-loading firearm having a nipple portion with a passage therein into its barrel. The device comprises a compressed gas source, a valve mounted in a valve body for selectively releasing gas from the compressed gas source, an adapter in the form of a hollow cylinder dimensionally sized to accept the nipple portion of the percussion muzzle-loading firearm therewith, the adapter includes means to provide an airtight seal around the nipple portion when the nipple portion is inserted with the adapter, and a valve actuator mounted for sliding movement within the hollow cylinder adapter for engaging the valve upon contact with the nipple portion of the percussion muzzle-loading firearm to release the selectively released gas.

The pneumatic discharging device can be modified for unloading or removing obstructions from a flintlock muzzle-loading firearm by changing the valve actuator. The valve actuator for the flintlock-type guns is in the form of an elongated tube dimensionally sized for insertion into or around the vent hole of the flintlock muzzle-loading firearm and adapted for engaging the valve after the insertion within the vent hole to release the selectively released gas.

Desirably, the means for providing an airtight seal is an O-ring seal mounted on an inner wall of the adapter. The valve actuator is adapted to release the gas upon contact with a portion of the firearm or can be a hand operated lever mechanism mounted on the valve body.

The device further includes a hollow handle to hold the cylinder to the valve body. The valve body includes means for piercing an end of the cylinder to release the compressed gas. The valve body and the hollow handle cooperate to provide means for advancing the cylinder causing its end to be pierced by the piercing means. The compressed gas source can be a cylinder filled with compressed carbon dioxide.

The invention will be more fully understood when reference is made to the following detailed description taken in conjunction with the accompanying drawings.

DETAILED DESCRIPTION OF THE INVENTION

Figure 1:
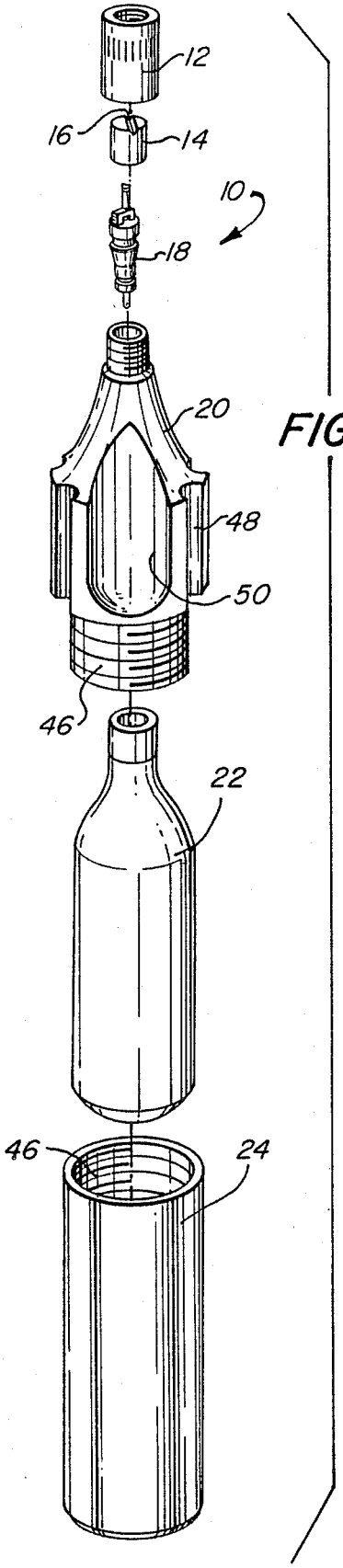
FIG. 1 is an exploded view of the first embodiment of the pneumatic projectile discharger for muzzle-loading firearms according to the invention herein

Referring first to FIG. 1, therein is illustrated the first embodiment of the pneumatic projectile discharger for muzzle-loading firearms according to the invention herein and generally designated by the numeral 10. The discharger device 10 is generally comprised of n adapter 12 in the form of a hollow cylinder, a cylindrical valve actuator 14 having a channel 16 extending across the upper end thereof, a spring-loaded valve 18, a valve body 20, a compressed gas cylinder 22 filled with, preferably, carbon dioxide gas at a pressure of eight hundred pounds per square inch (800 p.s.i.) and a hollow handle piece 24.

Figure 2:
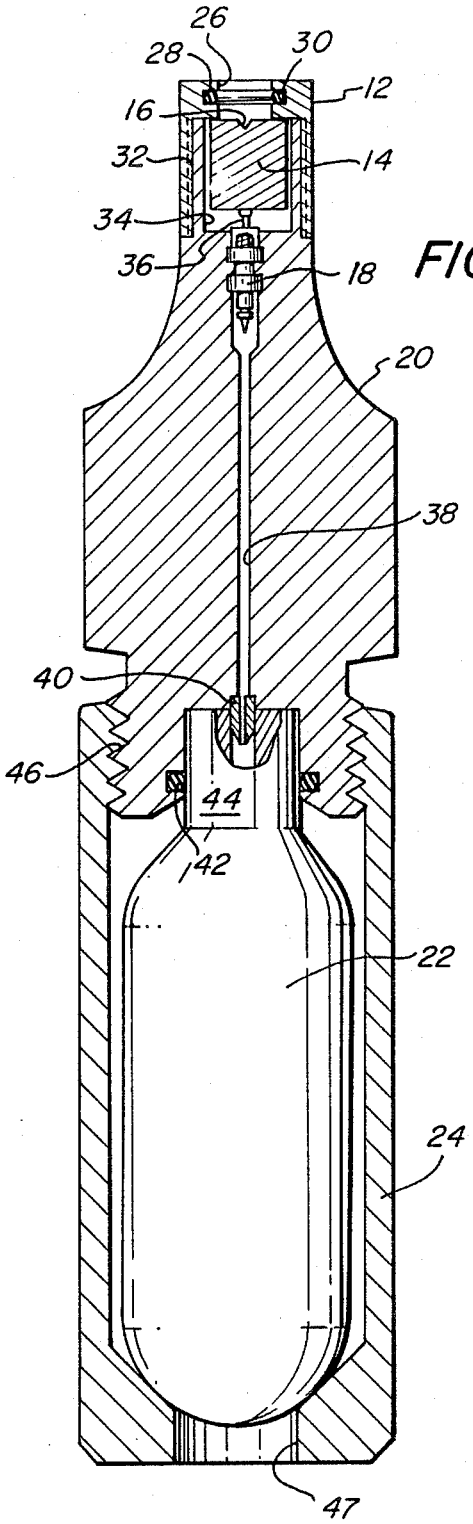
FIG. 2 is an enlarged cross sectional view of the first embodiment of the pneumatic projectile discharger for muzzle-loading firearms.

Turning now to FIG. 2, the adapter 12 is shown in the form of a hollow cylinder having a lesser inner diameter 26 at the upper end thereof. Within a slot or groove 28 located within the upper end of the adapter 12 is mounted an O-ring seal 30 for providing an airtight seal when the adapter 12 is inserted over a nipple portion of a percussion type muzzle-loading firearm. The adapter 12 is mounted on the upper end of the valve body 20 by means of mating screw threads 32 which hold the valve body 20 and the adapter 12 in releasable assembly. An alternative to the mating screw threads 32 would be providing a close sliding fit between the valve body 20 and adapter 12, including a spring clip (not shown) to secure the two components together The upper end of the valve body 20 is provided with an opening 34 dimensionally sized to slideably receive the cylindrical valve actuator 14. At the lower end of the opening 34, the spring-loaded valve 18 is firmly seated within the valve body with its stem 36 engaging the lower end of the actuator 14 which is loosely held within opening 34. The valve 18 is a conventional spring-loaded valve compatible with carbon dioxide and capable of withstanding the pressure exerted from the compressed gas cylinder. Located along the longitudinal axis of the valve body 20 is a connecting passage 38 operationally connecting the valve 18 with the compressed gas cylinder 22. The lower end of the connecting passage 38 is provided with a piercing pin 40 for piercing the end of the cylinder 22 to provide access to the compressed gas therein. An O-ring seal 42 is used in the valve body 20 to seal around the cylinder neck 44 and is a special type of seal compatible with carbon dioxide gas that will not swell during use and thereby prevent the removal and insertion of another cylinder until it shrinks to its original size.

As best seen in FIGS. 1 and 2, the valve body 20 and hollow handle piece 24 are connected by mating screw threads 46 which provide means for advancing the compressed gas cylinder 22 relative to the valve body 20 and against the piercing pin 40 for causing the end of the cylinder 22 to be pierced. When assembled, the cylinder 22 is seated within the confines of the hollow handle piece 24 which includes a lower locating aperture 47 for aligning the compressed gas cylinder 22 with the piercing pin 40. The outside of the valve body 20 includes flutes 48 to permit the valve body 20 to be easily grasped by the user enabling relative rotation between the valve body 20 and the hollow handle 24 and also between the valve body 20 and the adapter 12. The valve body 20 also defines a notch 50 on one side thereof whose purpose will be explained further hereinafter.

In connecting the compressed gas cylinder 22 to the discharge device 10, the hollow handle piece 24 is removed from the valve body 20 and the cylinder 22 of compressed gas is placed inside the hollow handle 22 with the neck 44 outward. The hollow handle 22 is then reattached to the valve body 20 by the mating screw threads 46. As the hollow handle piece 24 is turned, it advances the cylinder neck 44 through the valve body seal 42 and onto the piercing pin 40 thereby opening the cylinder 22 and releasing the gas. The pressurized gas is conducted through the connecting passage 38 of the valve body 20 and is stopped by the valve 18.

Figure 3:
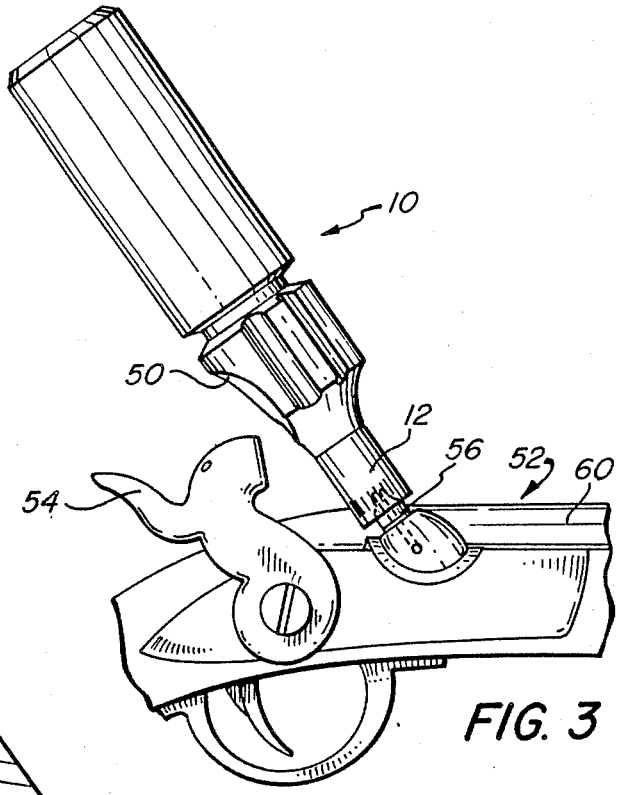
FIG. 3 is a partial side elevational view of a percussion muzzle-loading firearm with the first embodiment pneumatic projectile discharger being inserted on the nipple portion thereof
Figure 4:
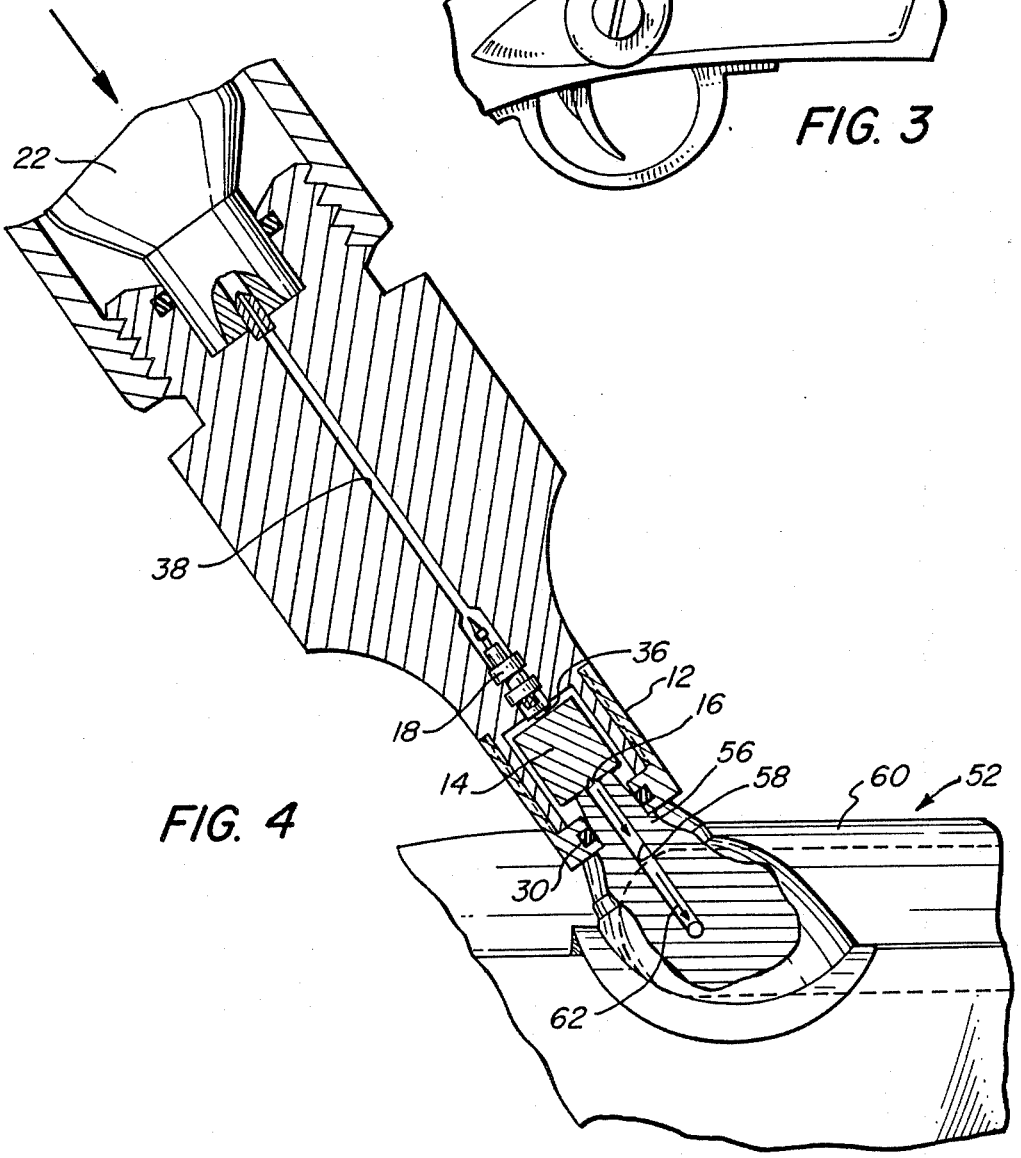
FIG. 4 is a side elevational view similar to FIG. 3 but greatly enlarged with the pneumatic projectile discharger in cross section and the nipple portion of the muzzle-loading firearm broken away to reveal internal structure.

Referring now to FIGS. 3 and 4, the pneumatic projectile discharge device 10 is shown in use with a percussion type muzzle-loading firearm generally indicated by numeral 52. The percussion gun 52 includes a hammer 54 and a nipple 56 upon which the percussion cap (not shown) would be positioned. As best seen in FIG. 4, the nipple 56 includes a nipple passageway 58 through which the spark travels to the charge (not shown) in the barrel 60 when the firearm 52 is fired.

In using the discharge device 10 to unload or remove an obstruction from the barrel 60 of the percussion firearm 52, the adapter 12 is placed against the nipple 56 of the firearm 52 and pushes onto it as shown in FIGS. 3 and 4. It should be appreciated that a plurality of adapters 12 can be provided, each with a different inner diameter 26 to accommodate the various standard sized nipples 56. The notch 50 is positioned adjacent the hammer 54 and provides clearance for the discharge device 10. The nipple 56 is made with a taper and the O-ring seal 30 accommodates the changing diameter and changing angles between the adapter 12 and the nipple 56. The nipple 56 entering the adapter 12 pushes the actuator 14 against the spring loaded valve stem 36 opening the valve 18. As indicated by arrows 62, the gas now released enters the breech of the gun 52 through the channel 16 and nipple passageway 62 behind the charge or obstruction (not shown) and pushes it through the barrel 60 and out of the gun 52.

Figure 5:
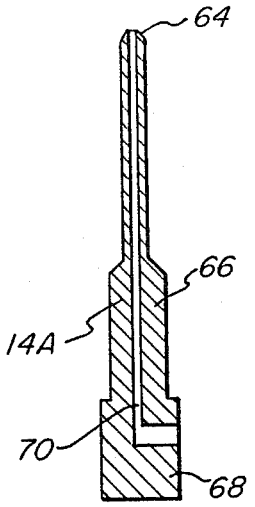
FIG. 5 is an enlarged cross sectional view of an actuator for use with flintlock muzzle-loading firearms.
Figure 6:
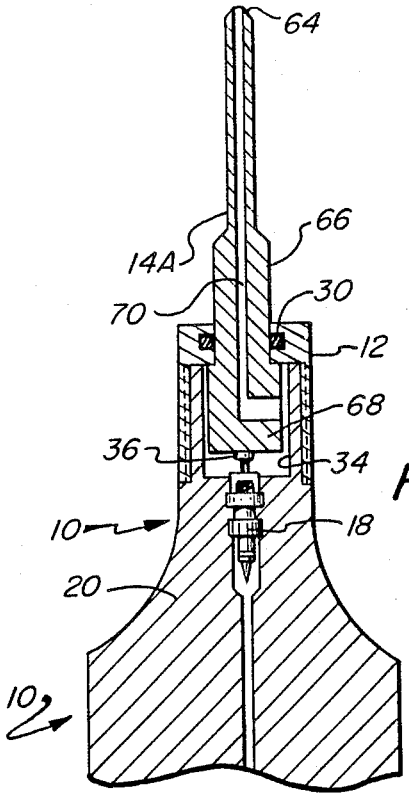
FIG. 6 is an enlarged partial cross sectional view of a first embodiment of the pneumatic projectile discharger of the present invention used with the adapter of FIG. 5 for use with flintlock muzzle-loading firearms.
Figure 7:
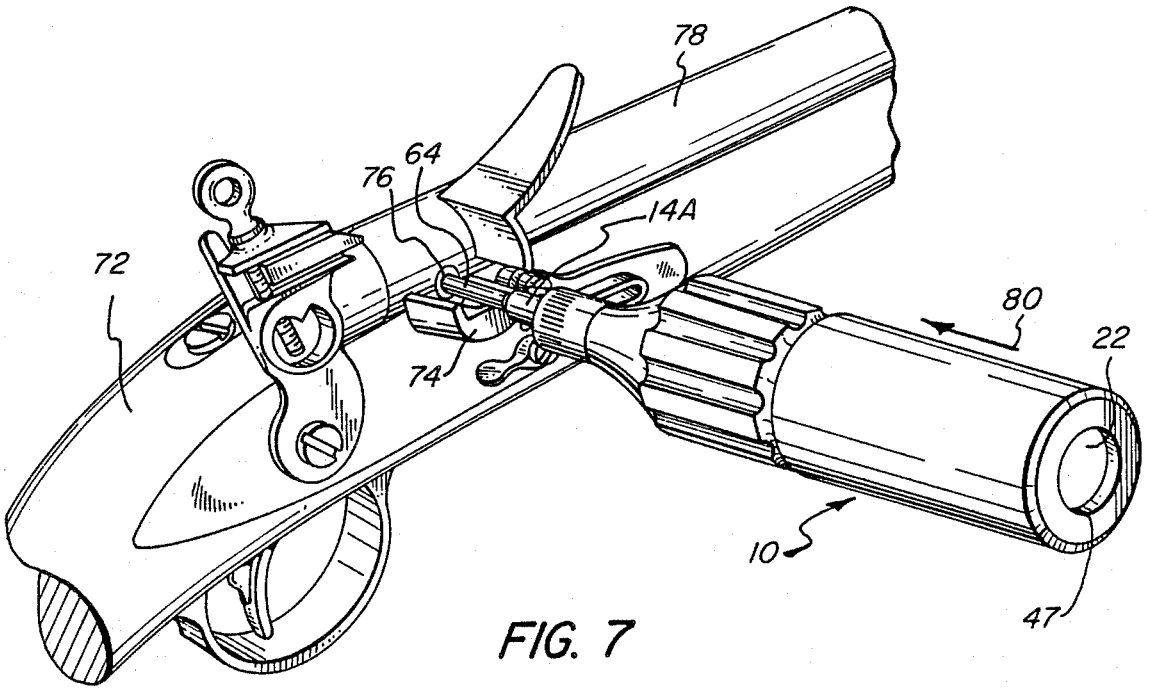
FIG. 7 is a partial perspective view of a flintlock muzzle-loading firearm with the FIG. 6 embodiment of the pneumatic projectile discharger being used therewith to unload or remove an obstruction from the barrel thereof.

Referring now to FIGS. 5 through 7, the pneumatic projectile discharger 10 adapted for use with flintlock-type muzzle-loading firearms is shown. FIG. 5 shows a tubular actuator 14A adapted for use with a flintlock-type muzzle-loading firearm and including an upper portion 64 dimensionally sized to fit in or against the vent hole thereof. To use the actuator 14A in the discharge device 10, the actuator 14 is removed by unscrewing the adapter 12 from the valve body 20 and replaced by adapter 14A. The central portion 66 of the actuator 14A is dimensionally sized to fit in an airtight relationship with respect to O-ring seal 30 in the lesser inner diameter 26 of the adapter 12 as shown in FIG. 6. The lower portion 68 of the actuator 14A is of the same size as the actuator 14 and is slideably received within the opening 34 of the valve body 20. A passageway 70 having a ninety (90) degree angle therein extends through the actuator 14A. When the actuator 14A is assembled in the discharge device 10, it is loosely held in opening 34 for engagement with the spring operated valve 18 as shown in FIG. 6.

As can be understood when viewing FIG. 7, to use the device 10 for unloading or removing an obstruction in a flintlock gun 72, it is laid across the flash pan 74 of the gun 72 with the upper end 64 in or against the vent 76. The vent 76 includes a passageway (not shown) into the gun barrel 78 similar to the nipple passageway 58 of the percussion gun 52. By moving the device 10 forward in the direction of arrow 80, the actuator 14A pushes against the valve stem 36 to open the valve 18 and release the compressed gas. The released gas travels through the passageway 70 in the actuator 14A into the breech of the gun 72 and pushes the charge or obstruction through the barrel 78 and out of the gun 72.

Figure 8:
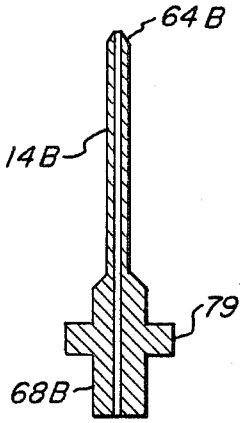
FIG. 8 is an enlarged cross sectional view of a different style actuator for use with flintlock muzzle-loading firearms.
Figure 9:
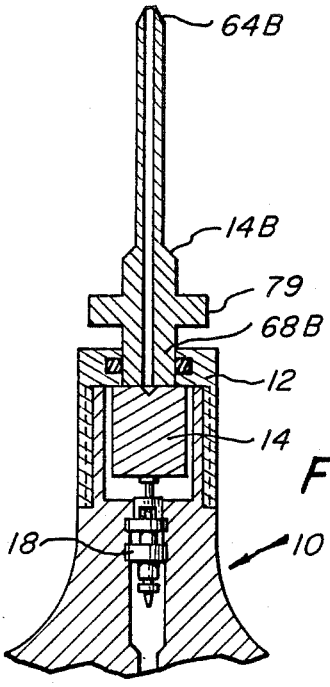
FIG. 9 is a view similar to FIG. 2 with the FIG. 8 actuator mounted in operating position in the first embodiment of the pneumatic projectile discharger.

Another style of actuator 14B for unloading and removing obstructions from a flintlock gun is illustrated in FIG. 8 and indicated by the numeral 14B. The actuator 14B is provided with a pointed tip portion 64B to fit in or against the vent hole of the flintlock gun. The actuator 14B has a lower seat portion 68B dimensionally sized to fit within the lesser inner diameter 26 of the adapter 12 and engage the cylindrical valve actuator 14 of the projectile discharger 10 as shown in FIG. 9. In use, the actuator 14B is positioned within or against the vent hole of the flintlock gun and the discharger 10 is advanced there towards, whereby the seat 68B engages the cylindrical actuator 14 which in turn actuates valve 18 to release the compressed gas to unload or clear an obstruction. The shoulder 79 is a finger gripping portion to facilitate handling of the actuator 14B during the unloading process.

Figure 10:
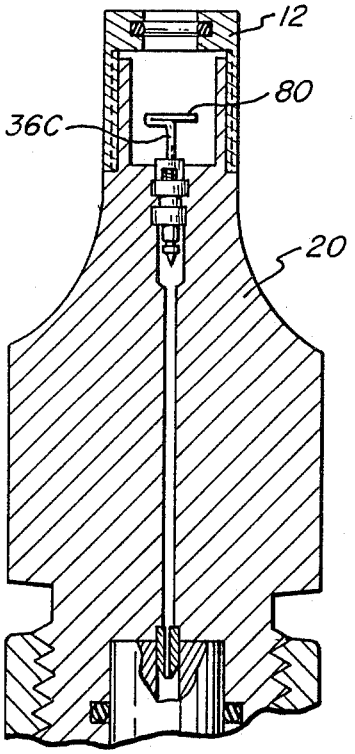
FIG. 10 is an enlarged partial cross sectional view of a second embodiment of the pneumatic projectile discharger of the present invention.
Figure 11:
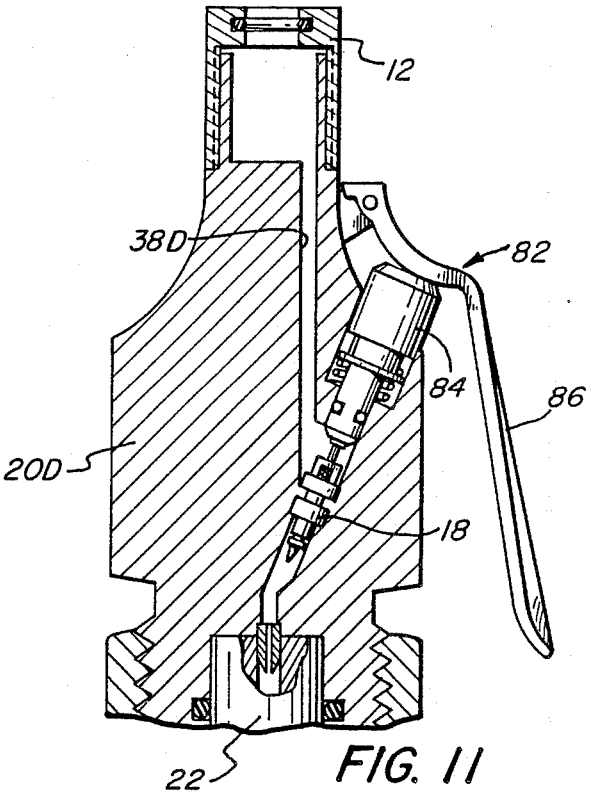
FIG. 11 is an enlarged partial cross sectional view of a third embodiment of the pneumatic projectile discharger of the present invention.

In FIGS. 10 and 11, two other embodiments of the pneumatic projectile discharger of the present invention are shown. These devices are quite similar to the first embodiment; however, they have different types of actuators for releasing the compressed gas. In the case of the embodiment shown in FIG. 10, the actuator 14 of the first embodiment is replaced by an enlarged valve stem 36C which includes a bent crossbar 80 on the end thereof for engaging the nipple 56 of the percussion gun 52 as it enters the adapter 12 in a manner similar to the first embodiment. Relative to the FIG. 11 embodiment, valve body 20D has been modified so that the valve 18 is placed in the connecting channel 38D at an angle thereto and is in operating contact with a hand operated actuator generally indicated by the numeral 82. The actuator 82 is comprised of spring bias plunger 84 and a lever 86 which is pivotally mounted to the outside of the valve body 20D. In use, when the nipple 56 of the percussion gun 52 enters the adapter 12 of the FIG. 11 embodiment discharger, the user of the device can manually actuate the valve 18 by use of the actuating lever 86 which engages the plunger 84 thereby engaging the spring-loaded valve 18 to release the compressed gas from the cylinder 22. It is also contemplated that the lever 86 could be eliminated whereby the user could actuate the device by manually engaging the plunger 84.

The discharger of the present invention could preferably come as a kit of elements including, for example, all the components shown in FIGS. 2 and 5. In addition, several adapters could be provided in the kit to accommodate different sized nipple portions on various percussion muzzle-loading firearms. The various components of the kit could then be assembled as previously described in the configuration need to perform a particular unloading or obstruction removing operation.

The ball discharger of the present invention is preferably manufactured from a metal material such as aluminum or steel, but it should be apparent to those skilled in the art that it maybe manufactured from other suitable materials such as plastic resins. The O-ring seals can be made from materials compatible with carbon dioxide such synthetic rubber (Buna-N).

Thus, it can be seen from the foregoing detailed specification and attached drawings that the pneumatic projectile discharger of the present invention provides an effective means to unload or remove an obstruction from the barrel of a muzzle-loading firearm.

The preferred embodiments described above admirably achieve the objects of the invention; however, it will be appreciated that various changes in the invention can be made by those skilled in the art without departing from the spirit and scope of the invention which is limited only by the following claims.

Having thus described the invention, I claim:

1. A pneumatic discharging device for unloading or removing obstructions from a muzzle-loading firearm having a firing mechanism with a passage extending into its barrel, said discharging device comprising:

a compressed gas source;

means for selectively releasing gas from said compressed gas source, said means for selectively releasing gas includes a valve mounted in a valve body and a valve actuator for engaging said valve to release said selectively released gas; and means for introducing said selectively released compressed gas into the passage of the firing mechanism to unload or remove an obstruction from the barrel of the muzzle-loading firearm, said means for introducing and said valve actuator are adapted to move relative to one another to release said gas when said valve actuator is pushed into contact with a portion of the firing mechanism of the firearm.

2. The pneumatic discharge device in accordance with claim 1 wherein said means for introducing said selectively released compressed gas is an adapter having an aperture defined therein dimensionally sized to accept a nipple portion of the firing mechanism of the muzzle-loading firearm.

3. The pneumatic discharge device in accordance with claim 2 wherein said adapter includes means for providing an airtight seal when the nipple portion of the firing mechanism is inserted within said aperture of said adapter.

4. The pneumatic discharge device in accordance with claim 3 wherein said means for providing an airtight seal is an O-ring seal mounted on said adapter.

5. The pneumatic discharge device in accordance with claim 4 wherein said O-ring seal is positioned within said aperture on an inner wall of said adapter.

6. The pneumatic discharge device in accordance with claim 1 wherein said valve actuator is an elongated tube dimensionally sized for insertion into or around the passage of the firing mechanism of the firearm and adapted to release said gas upon contact with a portion of the firearm.

7. The pneumatic discharge device in accordance with claim 1 wherein said compressed gas source is a cylinder filled with compressed gas.

8. The pneumatic discharge device in accordance with claim 7 further including handle means to hold said cylinder to said valve body.

9. The pneumatic discharge device in accordance with claim 8 wherein said valve body includes means for piercing an end of said cylinder to release said compressed gas.

10. The pneumatic discharge device in accordance with claim 9 wherein said valve body and said handle means cooperate to provide means for advancing said cylinder causing its end to be pierced by said piercing means.

11. The pneumatic discharge device in accordance with claim 1 wherein said compressed gas source is a cylinder filled with compressed carbon dioxide.

12. A pneumatic discharging device for unloading or removing obstructions from a percussion muzzle-loading firearm having a nipple portion with a passage therein into its barrel, said discharging device comprising:

a compressed gas source;

a valve mounted in a valve body for selectively releasing gas from said compressed gas source;

an adapter in the form of a hollow cylinder dimensionally sized to accept the nipple portion of the percussion muzzle-loading firearm, said adapter includes means to provide an airtight seal around the nipple portion when the nipple portion is inserted within said adapter; and a valve actuator mounted for sliding movement within said hollow cylinder adapter for engaging said valve upon contact with the nipple portion of the percussion muzzle-loading firearm to release said selectively released gas.

13. A pneumatic discharging device for unloading or removing obstructions from a flintlock muzzle-loading firearm having a vent hole therein into its barrel, said discharging device comprising:

a compressed gas source;

a valve mounted in a valve body for selectively releasing gas from said compressed gas source;

a valve actuator in the form of an elongated tube dimensionally sized for insertion into or around the vent hole of the flintlock muzzle-loading firearm and adapted for engaging said valve after the insertion within the vent hole to release said selectively released gas; and an adapter in the form of a hollow cylinder having said valve actuator slideably mounted therein, said adapter includes means to provide an airtight seal around said actuator.

14. A pneumatic discharging kit assembly for use in unloading or removing obstructions from a muzzle-loading firearm having a firing mechanism with a passage extending into its barrel, said discharging kit assembly comprising:

a compressed gas source;

means adapted to selectively release gas from said compressed gas source, said means for selectively releasing gas includes a valve mounted in a valve body and a valve actuator for engaging said valve to release said selectively released gas; and means adapted to introduce said selectively released compressed gas into the passage of the firing mechanism to unload or remove an obstruction from the barrel of the muzzle-loading firearm, said means for introducing and said valve actuator are adapted to move relative to one another to release said gas when said valve actuator is pushed into contact with a portion of the firing mechanism of the firearm.

15. The pneumatic discharging kit assembly in accordance with claim 14 wherein said means adapted to introduce said selectively released compressed gas is an adapter having an aperture defined therein dimensionally sized to accept a nipple portion of the firing mechanism of a percussion muzzle-loading firearm and to accept said valve actuator dimensionally sized for insertion into or around a vent hole of a flintlock muzzle-loading firearm.

16. The pneumatic discharging kit assembly in accordance with claim 14 wherein said valve actuator includes first and second valve actuators, said first valve actuator is adapted for use with percussion muzzle-loading firearm and said second valve actuator is adapted for use with a flintlock muzzle-loading firearm.

17. The pneumatic discharging kit assembly in accordance with claim 15 wherein said adapter is first and second adapters dimensionally sized to accept different size nipple portions of firing mechanisms of percussion muzzle-loading firearms.

18. A pneumatic discharging device for unloading or removing obstructions from a muzzle-loading firearm having a firing mechanism with a passage extending into its barrel, said discharging device comprising:

a compressed gas source;

means for selectively releasing gas from said compressed gas source; and means for introducing said selectively released compressed gas into the passage of the firing mechanism to unload or remove an obstruction from the barrel of the muzzle-loading firearm, said means for introducing said selectively released compressed gas is an adapter having an aperture defined therein dimensionally sized to accept a nipple portion of the firing mechanism of the muzzle-loading firearm.

19. The pneumatic discharge device in accordance with claim 18 wherein said adapter includes means for providing an airtight seal when the nipple portion of the firing mechanism is inserted within said aperture of said adapter.

20. The pneumatic discharge device in accordance with claim 19 wherein said means for providing an airtight seal is an O-ring seal mounted on said adapter.

21. The pneumatic discharge device in accordance with claim 20 wherein said O-ring seal is positioned within said aperture on an inner wall of said adapter.

22. The pneumatic discharging device in accordance with claim 18 wherein said means for selectively releasing includes a valve having an enlarged valve stem for engaging the nipple portion of the firing mechanism of the muzzle-loading firearm to release said gas.

23. A pneumatic discharging kit assembly for use in unloading or removing obstructions from a muzzle-loading firearm having a firing mechanism with a passage extending into its barrel, said discharging kit assembly comprising:

a compressed gas source;

means adapted to selectively release gas from said compressed gas source; and means adapted to introduce said selectively released compressed gas into the passage of the firing mechanism to unload or remove an obstruction from the barrel of the muzzle-loading firearm, said means adapted to introduce said selectively released compressed gas is an adapter having an aperture defined therein dimensionally sized to accept a nipple portion of the firing mechanism of a percussion muzzle-loading firearm and to accept a valve actuator dimensionally sized for insertion into or around a vent hole of a flintlock muzzle-loading firearm.

24. The pneumatic discharging kit assembly in accordance with claim 23 wherein said adapter is first and second adapters dimensionally sized to accept different size nipple portions of firing mechanisms of percussion muzzle-loading firearms.

25. A pneumatic discharging kit assembly for use in unloading or removing obstructions from a muzzle-loading firearm having a firing mechanism with a passage extending into its barrel, said discharging kit assembly comprising:

a compressed gas source;

means adapted to selectively release gas from said compressed gas source, said means adapted to introduce said selectively released compressed gas further includes first and second valve actuators, said first valve actuator is adapted for use with a percussion muzzle-loading firearm and said second valve actuator is adapted for use with a flintlock muzzle-loading firearm; and means adapted to introduce said selectively released compressed gas into the passage of the firing mechanism to unload or remove an obstruction from the barrel of the muzzle-loading firearm.

* * * * *